US006146007A

United States Patent [19]

Stimson et al.

[11] Patent Number: 6,146,007

[45] Date of Patent: Nov. 14, 2000

[54] ASPHALT PLANT HAVING CENTRALIZED MEDIA BURNER AND LOW FUGITIVE EMISSIONS

[75] Inventors: Martin L. Stimson, Center Point; Joseph E. Musil, Ely, both of Iowa

[73] Assignee: Cedarapids Inc., Cedar Rapids, Iowa

[21] Appl. No.: 09/045,212

[22] Filed: Mar. 20, 1998

[51] Int. Cl.[7] ..... B28C 5/46

[52] U.S. Cl. ..... 366/23; 366/25; 431/5; 431/7; 431/170

[58] Field of Search ..... 366/22, 23, 24, 366/25, 4, 7, 10, 11, 12, 13; 431/5, 7, 170, 186, 198; 110/345

[56] References Cited

U.S. PATENT DOCUMENTS

| | | | |
|---|---|---|---|
| 3,622,748 | 11/1971 | Sellers | 392/456 |
| 3,791,923 | 2/1974 | Bhan . | |
| 3,853,482 | 12/1974 | Bhan . | |
| 3,880,143 | 4/1975 | Hart et al. | 126/343.5 A |
| 3,898,040 | 8/1975 | Tabak . | |
| 4,477,250 | 10/1984 | Brashears et al. | 432/3 |
| 4,495,154 | 1/1985 | Christner et al. . | |
| 4,648,330 | 3/1987 | Delebarre | 110/263 |
| 4,688,495 | 8/1987 | Galloway . | |
| 4,702,892 | 10/1987 | Betz . | |
| 4,714,593 | 12/1987 | Naito et al. . | |
| 4,823,711 | 4/1989 | Kroneberger et al. . | |
| 4,845,941 | 7/1989 | Paul . | |
| 4,867,949 | 9/1989 | Betz . | |
| 5,165,884 | 11/1992 | Martin et al. . | |
| 5,199,961 | 4/1993 | Ohsaki et al. . | |
| 5,347,936 | 9/1994 | Thornhuus . | |
| 5,376,340 | 12/1994 | Bayer et al. | 422/175 |
| 5,470,360 | 11/1995 | Sederquist . | |
| 5,508,007 | 4/1996 | Vidal et al. . | |
| 5,601,790 | 2/1997 | Stilger et al. | 422/168 |
| 5,620,249 | 4/1997 | Musil et al. . | |
| 5,634,712 | 6/1997 | Musil | 366/22 |
| 5,635,139 | 6/1997 | Holst et al. | 422/108 |
| 5,810,471 | 9/1998 | Nath et al. | 366/25 |
| 5,902,040 | 5/1999 | Catlett | 366/25 |
| 5,989,010 | 11/1999 | Martin et al. | 431/7 |

OTHER PUBLICATIONS

"Flameless Thermal Oxidizers for VOC Control", © 1992, Thermatrix Inc., 3 pages.

Binder, William D., Martin, Richard J., "The Destruction of Air Toxic Emissions by Flameless Thermal Oxidation" © 1993, Thermatrix Inc., 18 pages.

*Primary Examiner*—W. L. Walker
*Assistant Examiner*—Richard W. Ward
*Attorney, Agent, or Firm*—Marshall, O'Toole, Gerstein, Murray & Borun

[57] ABSTRACT

An asphalt plant including a plurality of asphalt processing components, with a selected first set of the components producing volatile emissions and a selected second set requiring process heat energy. A central burner assembly is connected to the selected second set of components by an insulated duct system for providing heat energy to the second component set. A first duct system is adapted to capture a portion of the volatile emissions produced by the first component set and convey the captured emissions into the central burner for mitigation. The central burner is preferably a media burner incorporating flameless combustion technology as well as an adjustable internal fuel injection system, which results in safer and more controllable combustion. Even with captured fugitive emissions in the inlet air, the fuel injection system keeps the concentration of combustible materials well below the lower flammability limit.

18 Claims, 5 Drawing Sheets

ASPHALT PLANT HAVING CENTRALIZED MEDIA BURNER AND LOW FUGITIVE EMISSIONS

FIELD OF THE INVENTION

The present invention relates generally to an asphalt plant having a centralized media burner and exhibiting greatly reduced fugitive emissions. More specifically, the present invention uses a centralized media burner to both mitigate captured fugitive emissions and to supply process heat energy to the various plant components. The media burner uses an internal add fuel injection system which permits much greater control over the combustion process and which is much safer than externally fueled burners.

BACKGROUND OF THE INVENTION

On asphalt plants it is desirable to have a variety of air pollution control measures. The asphalt making process, by its very nature of heating and processing the bituminous asphalt components, produces a considerable quantity of undesirable hydrocarbons (HC), carbon monoxide (CO), nitrogen oxides (NOx), particulate matter and other emissions which constitute the unfortunate signature plume of an asphalt plant, commonly referred to as "blue smoke." In addition to being a source of air pollution, asphalt plants are noisy and visually unappealing, owing to their network of open conveyors, hoppers, bins, blowers and other heating and material handling equipment. Accordingly, asphalt plants in general are regarded as quite a nuisance, especially in and around residential areas.

The typical asphalt plant has high energy requirements. The drum dryer/mixer typically includes a gas burner to dry the aggregate material and to heat the mixing zone to foster adequate mixing of the aggregate with the liquid asphalt. The asphalt material contained in the asphalt storage tanks must be constantly heated to maintain the asphalt cement in its liquid state, and thus another gas burner or similar heating system is required in order to constantly heat the storage tanks. Thus, burner emission are created at both the asphalt storage tanks and at the drum dryer/mixer.

Moreover, the volatile components of the heated asphalt cement as well as the finished asphalt create a certain amount of fugitive emissions as the asphalt components and the finished asphalt are stored, mixed, and transported through the plant. Furthermore, the asphalt cement storage tanks and the asphalt storage silos are usually vented in order to prevent undue pressure build up, especially on hot days, which further complicates the fugitive emission problem. Additional fugitive emissions are created when the finished asphalt material is loaded onto trucks for transport to a job site.

One approach to alleviating the fugitive emission problem has been to enclose portions or all of the plant in order to minimize the amount of leakage from the ductwork and conveyors in the plant. Such an approach, an example of which is described more fully in U.S. Pat. No. 5,620,249, does not provide an improved mitigation system and is typically best suited for applications in which the plant can be made very compact, which is not always feasible.

Attempts have also been made to apply flameless media burner technology to asphalt plants. Media burner technology uses a bed or matrix of ceramic materials which act as a flame arrestor, thereby controlling the rate and temperature of the combustion process. Externally mixed fuel is added to the media burner, which is preheated until a self-sustaining combustion is initiated. Ideally, a very efficient centralized media burner should be able to supply heat to the various process components, so that the maximum amount of energy is extracted from the consumed fuel. Unfortunately, existing media burner technology has proven unsatisfactory for asphalt processing plants. The externally mixed fuel components have proven to be too explosive for safe, everyday applications.

Accordingly, there exists a need for an improved asphalt plant that will produce significantly less process and fugitive emissions. There also exists a need for an improved asphalt plant having a centralized heat source incorporating safer and more reliable media burner technology. Such an improved media burner should function to supply all plant process heat requirements and should function to mitigate captured fugitive emissions.

SUMMARY OF THE INVENTION

An asphalt plant according to the present invention uses an improved central media burner incorporating an adjustable internal add fuel injection system, which eliminates the potential for external fuel source explosion and results in a safer combustion unit. The central media burner is connected to the various plant processing components by a system of ductwork, with portions of the duct system capturing fugitive emissions from the plant components, such as the asphalt cement storage tanks, the asphalt storage silos, and the truck loading area. A separate insulated duct system routes heat energy from the media burner directly to the drum dryer/mixer, thus eliminating the need for a gas burner within the drum. Insulated ducts also convey heat energy to the asphalt batcher, the conveyors, and other components as needed. The media burner also incorporates an internal heat exchanger system, which heats oil that is routed to another heat exchanger in the asphalt cement storage tanks in order to maintain the asphalt cement in its liquid state, thus eliminating the separate storage tank burner system.

The media burner uses a flameless combustion chamber having a bed of ceramic members which give the media burner a very large thermal inertia, thus enabling the burner to be available for use as a mitigating and non-main load heat source for hours or even days after the burner was last actively fueled. The improved media burner incorporates a system of adjustable fuel injection lances or rods in conjunction with an adjustable air feed system, thereby permitting greater control of the combustion process. The adjustable fuel injection rods permit the fuel to be introduced at a variable level within the media bed, and further permit different sections of the burner to be fueled at different rates. The adjustable fuel injection permits precise temperature control within all regions of the media bed. Captured fugitive emissions, which tend to be in very low concentrations, can be fed into the media burner through the air inlet system. No external fuel mixing is required, and thus the potential for explosion is reduced if not eliminated.

The controlled combustion within the media burner creates very low emissions, and in the desired temperature range will prevent the formation of certain NOx compounds and other undesirable combustion by products. Consequently, the media burner is ideally suited for use as a mitigating means for treating fumes from the mixing zone of the drum dryer/mixer, as well as fumes from the asphalt cement storage tanks, the slat conveyors, the silos, and the truck loadout area. The media burner is non-recuperative in that no heat is diverted to pre-heat the incoming combustion air or fuel. Thus, all heat energy is available for process requirements and other plant needs. Moreover, due to the flameless combustion process, the media burner is inherently quiet and does not use high pressure blowers and exhibits low pulsation.

According to one aspect of the invention, an asphalt plant includes a plurality of asphalt processing components, with a selected first set of the components producing volatile emissions. A central burner assembly is connected to a selected second set of components for providing heat energy to the second component set. A first duct system is adapted to capture a portion of the volatile emissions produced by the first component set and convey the captured emissions into the central burner for mitigation, while a second duct system, which is preferably insulated, is in flow communication with the second component set and the central burner. The second duct system is adapted to convey heat energy from the central burner to the second component set.

The first component set may include, for example, an asphalt cement storage tank, an asphalt storage silo, a batcher silo, the mixing zone of the rotating drum dryer/mixer, and a truck loading area, each of which may produce volatile emissions requiring mitigation. The second component set may include, for example, portions of the rotary drum dryer/mixer, the asphalt cement storage tank, and other portions of the plant requiring a supply of heat energy. The central burner preferably includes a heat exchange unit that scavenges heat from the burner assembly sidewalls and conveys the heat energy, via a closed system of heating oil, to a heat exchange unit in the asphalt storage tank.

The burner assembly preferably comprises a media burner which employs flameless combustion technology and includes an enclosed combustion chamber defined in part by a top wall, a bottom wall, and an interconnecting sidewall, and which contains a matrix of ceramic members, such as saddle shapes, balls, or bone shaped ceramic elements. The media burner is provided with an internal fuel delivery system, which is preferably adjustable to permit the fuel to be injected at different locations within the media burner, thereby permitting precise control of the temperature within different regions or different elevations within the media burner. The rod assemblies are preferably arranged in rows or groups, which further enhances control of the combustion process.

The fuel delivery system includes a fuel manifold and a plurality of fuel rod assemblies having a portion extending into the combustion chamber. Each of the fuel rod assemblies includes an outer tube having a sidewall defining a chamber and having at least one fuel port, and an inner conduit disposed within the outer tube and being in flow communication with the fuel manifold. The inner conduit includes an outlet end having an orifice for delivering fuel to the outer tube chamber, from where the fuel is delivered to the combustion chamber. The inner conduit includes an inlet end connected to the fuel manifold by a flexible hose, and also includes a pair of spaced apart seals sized to be received within the outer tube. The seals cooperate to confine the fuel to a selected portion of the outer tube cavity, and the inner conduit can be adjusted along the length of the outer tube in order to deliver fuel through at a selected level within the media burner through a plurality of fuel ports in the outer tube. The slidable inner conduit includes a locking collar or ferrule for fixing the position of the inner conduit relative to the outer tube.

A portion of the duct system is adapted to deliver captured fugitive emissions to an air plenum, and the air plenum delivers a mixture of combustion air and captured fugitive emissions to the combustion chamber. An air valve having a slidable baffle controls the flow of combustion air and captured fugitive emissions from the air plenum to the combustion chamber.

According to another aspect of the invention, a media burner for providing thermal energy to a selected set of components in an asphalt plant comprises an enclosed combustion chamber defined in part by a top wall, a bottom wall, and an interconnecting sidewall. A portion of the combustion chamber contains a matrix of ceramic members. An adjustable internal fuel delivery system delivers fuel to a selected location in the combustion chamber, while an air inlet plenum is provided for delivering combustion air to the combustion chamber.

According to yet another aspect of the invention, an asphalt plant comprises a plurality of asphalt processing components, a selected first set of the components producing volatile emissions, and a central media burner operatively connected to a selected second set of components by an insulated duct system for providing heat energy to the second component set. The media burner includes a combustion chamber containing a matrix of flame arresting ceramic members and a fuel delivery system adapted to deliver combustion fuel to the combustion chamber. A first duct system communicates with, and captures and conveys volatile emissions to, the media burner.

These and other objects, features and advantages of the present invention will become readily apparent to those skilled in the art upon a reading of the following description and claims.

DETAILED DESCRIPTION OF THE INVENTION

The following detailed description is not intended to limit the invention to the precise form disclosed. The embodiments described in detail have been chosen in order to best explain the principles of the invention so that others skilled in the art may follow its teachings.

Figure 1:
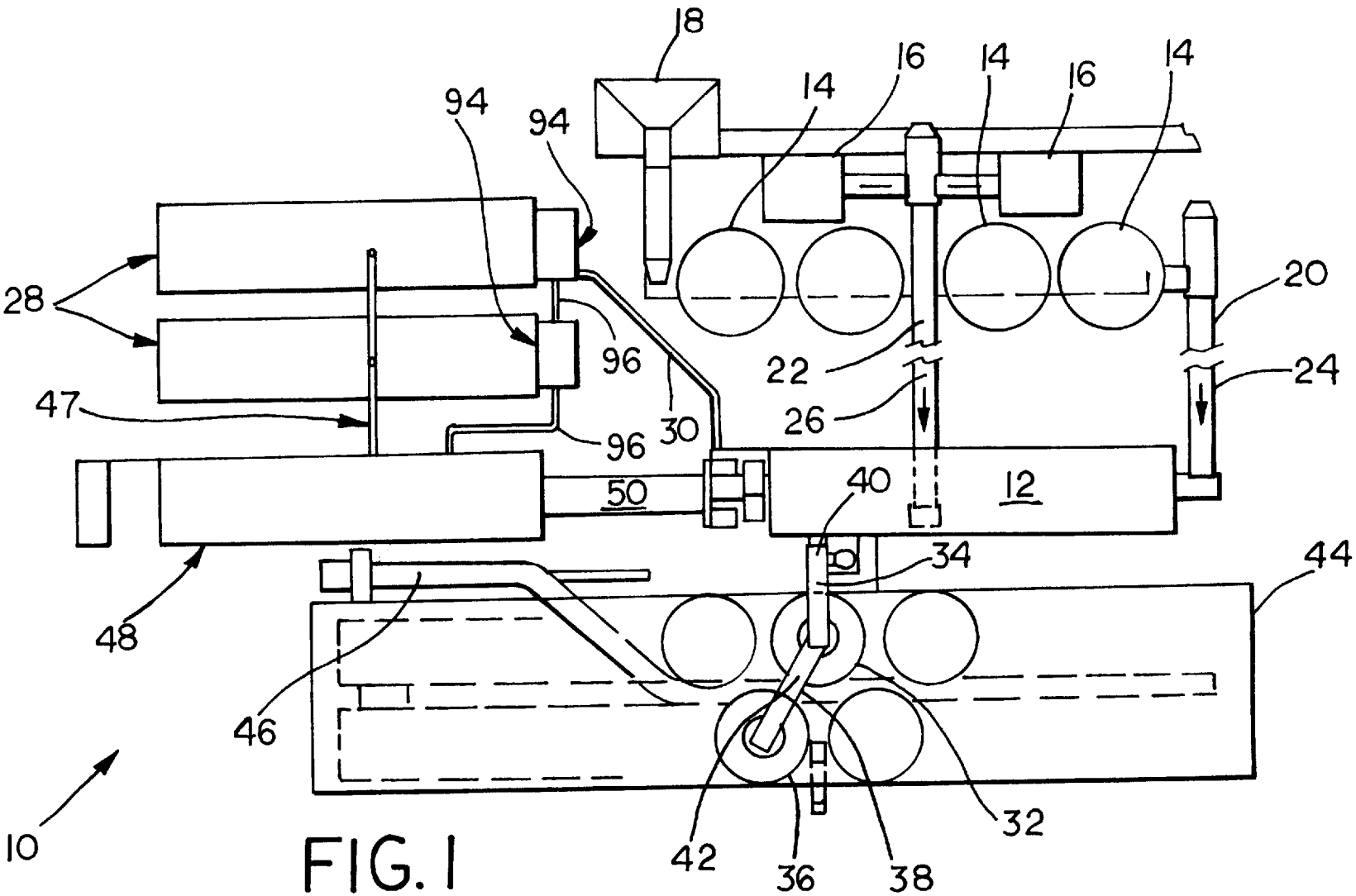
FIG. 1 is a top plan diagrammatic view of an asphalt plant incorporating the features of the present invention.
Figure 2:
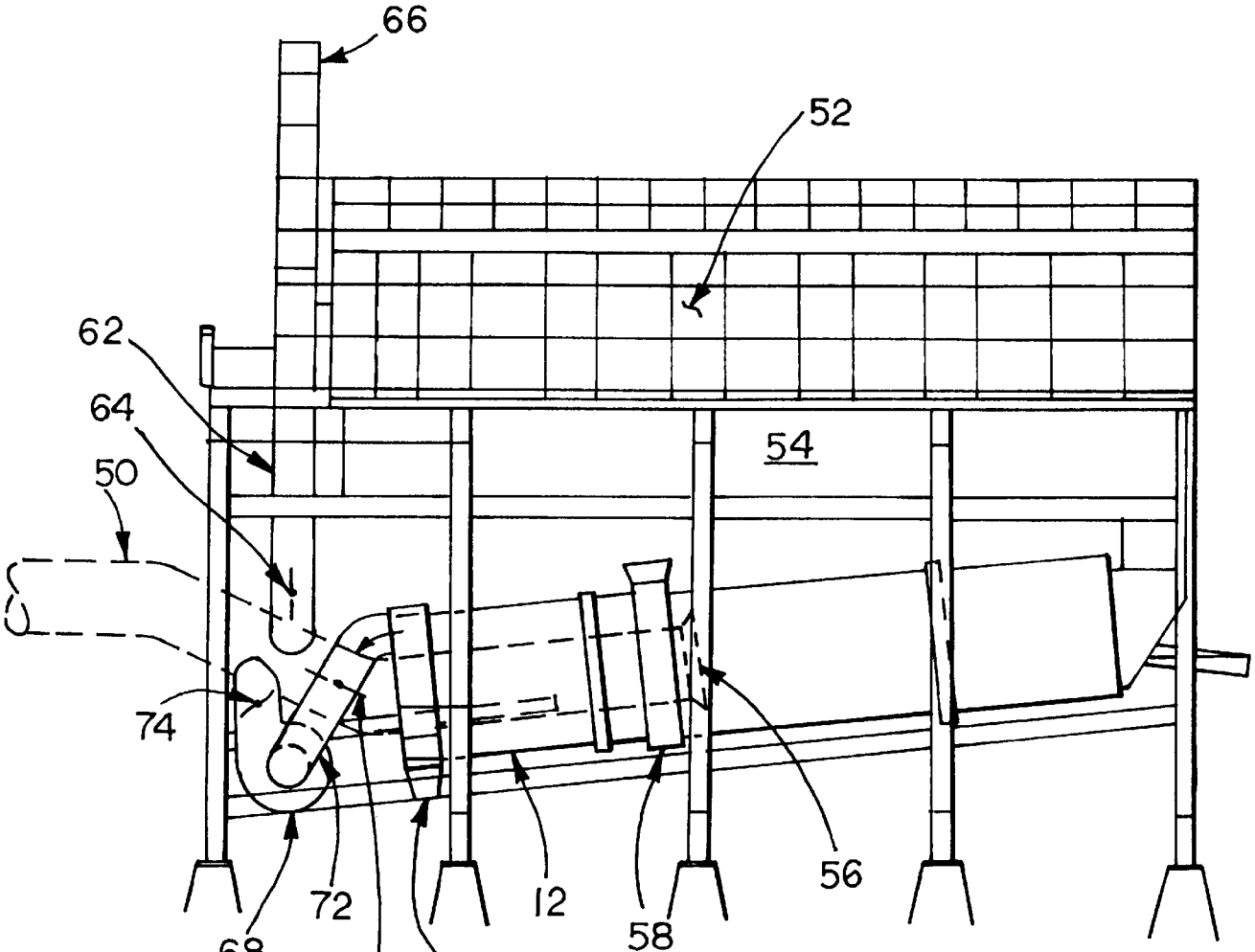
FIG. 2 is a fragmentary elevational view of the drum dryer/mixer and the baghouse filter illustrating the insulated duct from the media burner routed into the mixing zone of the drum dryer/mixer.

Referring now to the drawings, FIGS. 1 and 2 illustrate an asphalt plant incorporating features of the present invention and generally referred to by the reference numeral 10. The asphalt plant typically includes a variety of plant processing components, such as those components outlined in more detail in U.S. Pat. No. 5,620,249, the disclosure of which is incorporated herein by reference. Asphalt plant 10 typically includes a rotating drum dryer/mixer 12. The drum dryer/mixer 12 is preferably of the counterflow design, although a parallel flow drum dryer/mixer could also be used. Asphalt plant 10 also typically includes a plurality of virgin aggregate silos 14, a recycled asphalt product (RAP) storage bin 16, and a virgin aggregate hopper 18. A conveyor 20 is provided to transport the virgin aggregate to the drum dryer/mixer 12, while a RAP conveyor 22 is provided to transport the RAP to the drum dryer/mixer 12. The conveyors 20, 22 may be slat conveyors or other conventional designs. Each conveyor 20, 22 is preferably enclosed by a duct 24, 26, respectively. One or more asphalt cement storage tanks 28 are provided, which supply liquid asphalt to the drum dryer/mixer 12 via a feed line 30 as is well known in the art.

Finished hot mix asphalt produced in the drum dryer/mixer 12 is conveyed to a batcher silo 32 by a bucket conveyor 34, from where the asphalt is transferred to one or more loadout silos 36 by a conveyor 38. The bucket conveyor 34 and the conveyor 38 are each enclosed by a duct 40, 42, respectively. The loadout silos are preferably mounted over an enclosure 44 sized to receive a transport vehicle (not shown). Each of the drum dryer/mixer 12, the conveyors 22, 24, 34, 38, and the silos 32 and 36 are likely to release volatile emissions, which are captured by a portion of the duct systems 24, 26, 40, 42 and the enclosure 44. The captured emissions are routed to a return duct 46, and then to a central burner 48 as outlined below. Another return duct 47 is provided which routes captured emissions from the storage tanks 28 to the central burner 48 as will be discussed in greater detail below.

The central burner 48, which is preferably a media burner employing flameless combustion technology. A more complete explanation of flameless combustion technology can be found in U.S. Pat. No. 5,165,884, the disclosure of which is incorporated herein by reference. The return duct 46 is connected to the burner 48 for routing the captured emissions within the duct 46 to the burner 48 for mitigation as will be explained in greater detail below. Burner 48 includes an insulated duct 50 which routes heat energy to the drum dryer/mixer 12. Additional heat energy may be routed to other components as needed using additional ducts (not shown). Each of the above mentioned ducts preferably is insulated and includes one or more dampers for closing portions of the ducts during plant start up or as may otherwise be required.

As shown in FIG. 2, a filter or baghouse 52 is provided for capturing particulate emission from the drum dryer/mixer 12 in a manner well known in the art. An insulated duct 54 routes the exiting gas stream from the drum dryer/mixer 12 to the baghouse 52, and duct 54 is also connected to return duct 46 for routing emissions to the burner 48. The heat energy from the drum dryer/mixer 12, which has been routed through the insulated duct 50, enters the interior of the drum dryer/mixer 12 at an exit point 56.

Also as shown in FIG. 2, the drum dryer/mixer 12 preferably includes a collar 58 for introducing RAP into the drum dryer/mixer 12, a discharge hood 60 for routing finished hot mix asphalt out of the drum dryer/mixer 12, and an insulated duct 62 having a damper 64 that connects the drum dryer/mixer 12 to the stack 66 of the baghouse 54. A fan 68 in conjunction with a damper 70 controls the flow of gases from the mixing zone 73 of the drum dryer/mixer 12 to the insulated duct 50 via an insulated duct 72. Another damper 74 controls the flow of gases into the duct 50.

Figure 3:
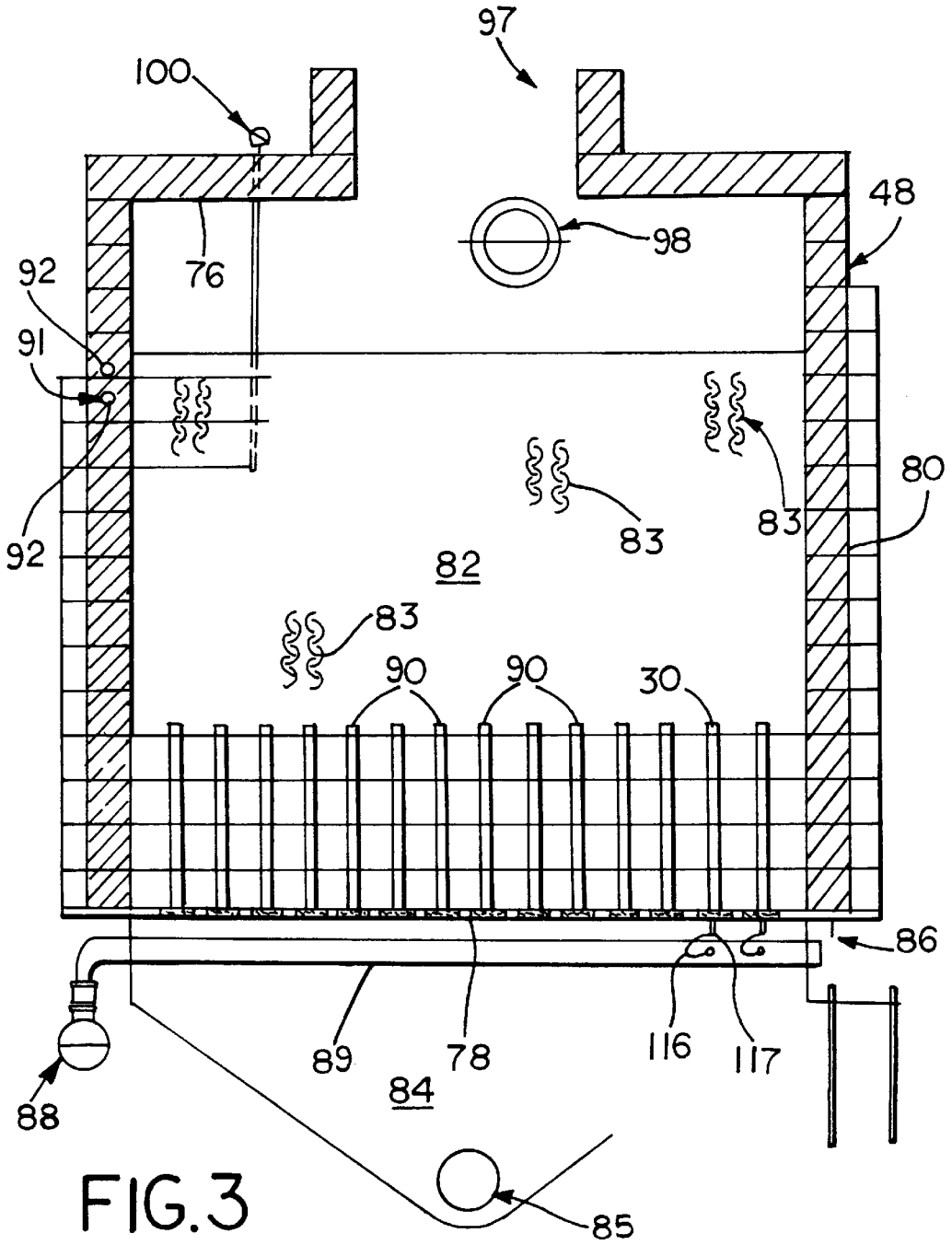
FIG. 3 is an enlarged elevational view in cross-section of the media burner having the internal add fuel injection system.

Referring now to FIG. 3, media burner 48 includes a top wall 76, a bottom wall 78, and continuous sidewalls 80 enclosing an internal combustion chamber 82. A plurality of ceramic members 83, such as saddles, balls, or other shapes, are disposed within the combustion chamber 82. The ceramic members 83 function to control the combustion process and will exhibit very high thermal inertia. The ceramic members may be any suitable shape, such as saddle shaped, round or spherically shaped, or "dog bone" shaped. An air inlet plenum 84, which is connected to outside air as well as to the return ducts 46 and 47, is provided for routing air and captured emissions to the combustion chamber via an air inlet valve assembly 86. The plenum 84 includes an auger 85 to permit periodic removal of the ceramic members 83, which may be released through the valve assembly 86 if needed.

A fuel delivery assembly 88 is provided for routing combustion fuel to the combustion chamber 82, and includes a fuel manifold 89 and a plurality of fuel injection lances or rods 90. The sidewall 80 of burner 48 includes a heat exchange unit 91 having a plurality of oil lines 92 which scavenge heat from the burner 48. The oil lines 92 route heated oil to a heat exchanger 94 on each of the asphalt cement storage tanks 28 via a feed line 96, which helps to maintain the asphalt within the storage tanks 28 in a liquid state. Burner 48 also includes a hot air outlet 97 connected to the insulated duct 50, a pre-heater 98 for heating the burner in preparation for start up, and a system of thermocouples 100.

Figure 4:
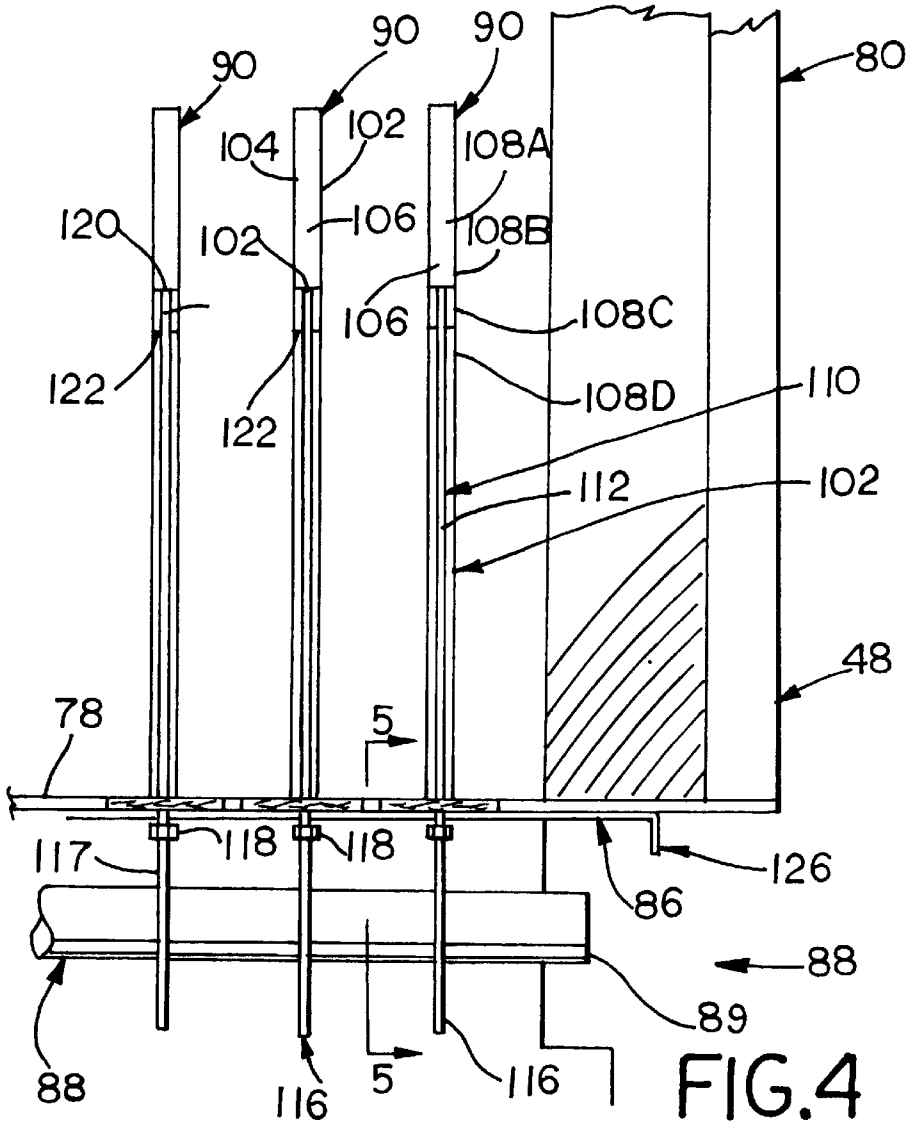
FIG. 4 is an enlarged fragmentary elevational view of the media burner internal fuel injection system.
Figure 5:
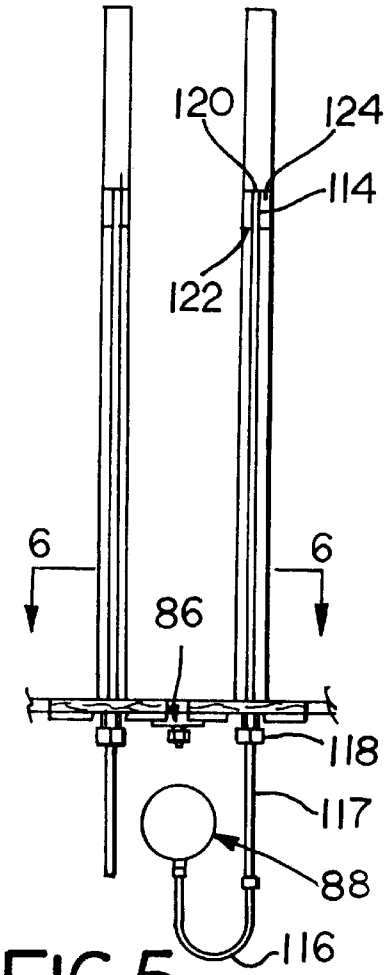
FIG. 5 is an enlarged fragmentary elevational view taken along lines 5—5 of FIG. 4.

As shown in FIGS. 3–5, the fuel rods 90 are arranged in a plurality of rows. Each fuel rod 90 includes an outer tube 102 having a sidewall 104 enclosing a chamber 106. A plurality of fuel ports, for example, 108*a*, 108*b*, 108*c*, . . . 108*n*, are provided in the sidewall 104. An inner conduit 110 is slidably disposed within each of the outer tubes 102, with each conduit 110 including a fuel flow passage 112 terminating in an orifice 114. The fuel passage 112 is connected to the fuel manifold 89 by a flexible hose 116 connected to an inlet end 117 of the conduit 110. Each inner conduit 110 includes an adjustable locking collar 118, which permits the inner conduit 110 to be adjusted relative to the outer tube 102. A pair of spaced apart seals 120, 122 are connected to an outlet end 124 of the inner conduit 110, with the orifice 114 being located between the seals 120, 122. Accordingly, fuel from the fuel manifold 88 is routed through the flexible hose 116, into the fuel passage 112, and into that the portion of the chamber 106 dictated by the present location of the inner conduit 110 (i.e., the present location of the seals 120, 122) relative to the outer tube 102. The fuel exits the chamber 106 via the closest adjacent fuel port 108*a*, 108*b*, 108*c*, or 108*n*, again depending on the position of the inner conduit 110 relative to the outer tube 102.

Figure 6:
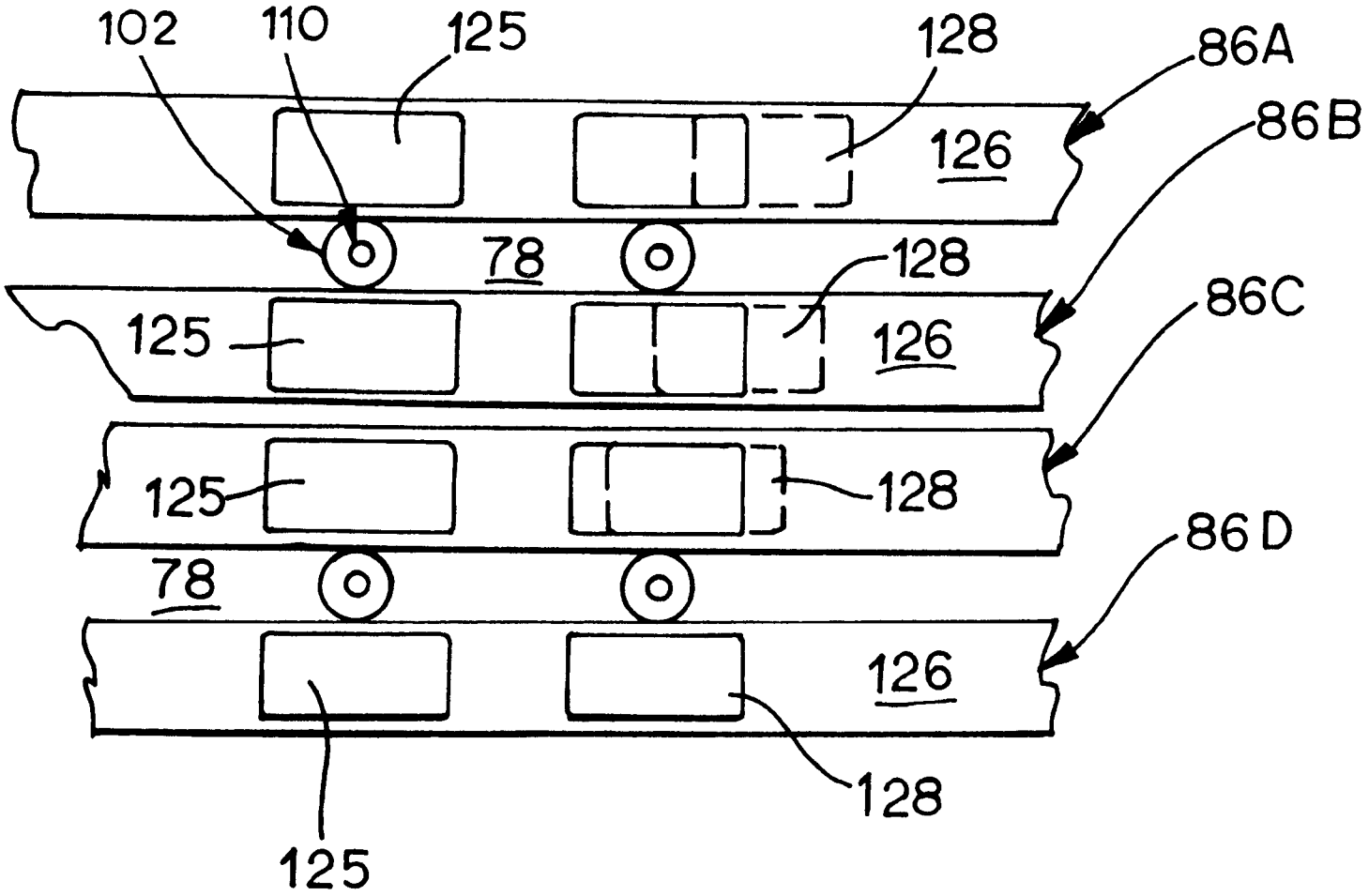
FIG. 6 is an enlarged fragmentary plan view taken along lines 6—6 of FIG. 5 illustrating the air valve assembly.

Referring now to FIGS. 4–6, the air valve assembly 86 includes a plurality of valves, for example 86*a*, 86*b*, 86*c*, and 86*d*, each of which is shown in a different position in FIG. 6. A plurality of spaced apart holes 125 are provided in the bottom wall 78 of the burner 48, which holes 125 communicate air from the air inlet plenum 84 to the combustion chamber 82. A baffle member 126 is slidably mounted to the bottom wall 78 and also includes a plurality of spaced apart holes 128, which are spaced to match the spacing of holes 125. Accordingly, the amount of air flowing through the holes 125 can be controlled by sliding the baffle member 126 back and forth on the bottom wall 78 having the holes 125. For example, the air flow can be maximized by sliding the baffle member 126 to the position of valve 86*a* at the top of FIG. 6, or minimized by sliding the baffle member 126 to the position of valve 86*d* at the bottom of FIG. 6, with valves 86*b* and 86*c* being shown in intermediate positions.

What is claimed:

1. An asphalt plant , comprising:

a plurality of asphalt processing components, a selected first set of the components producing volatile emissions;

a central burner comprising a media burner and being operatively connected to a selected second set of components for providing heat energy to the second component set , the media burner including an enclosed combustion chamber defined in part by a top wall, a bottom wall, and an inter connecting sidewall, a portion of the combustion chamber containing a matrix of ceramic members, the media burner further including a fuel delivery system adapted to convey fuel to an internal portion of the media burner, the fuel delivery system including a fuel manifold and a plurality of fuel rod assemblies, each of the fuel rod assemblies including a portion extending into the combustion chamber, an outer tube having a sidewall defining a chamber, the outer tube sidewall having at least one fuel port, and an inner conduit disposed within the outer tube and being in flow communication with the fuel manifold, the inner conduit including an outlet end having an orifice for delivering fuel to the outer tube chamber so that the outer tube fuel port delivers fuel from the outer tube chamber to the combustion chamber;

a fir st duct system in flow communication with the first component set and the central burner, the first duct system including a fan and being adapted t capture a portion of the volatile emissions produced by the first component set and convey the captured emissions into the central burner for mitigation; and a second duct system in flow communication with the second component set and the central burner, the second duct system including a fan and being adapted to convey heat energy from the central burner to the second component set.

2. The asphalt plant of claim 1, wherein the inner conduit includes an inlet end connected to the fuel manifold by a flexible hose.

3. The asphalt plant of claim 1, wherein the inner conduit includes a pair of spaced apart seals sized to be received within the outer tube, the seals cooperating to confine the fuel to a selected portion of the outer tube cavity.

4. The asphalt plant of claim 3, wherein the outer tube includes a plurality of fuel ports spaced along the length of the outer tube and wherein the inner conduit is slidably disposed within the outer tube, thereby permitting the selected portion to be adjusted along the length of the outer tube to deliver the fuel to a selected one of the fuel ports.

5. The asphalt plant of claim 4, wherein the inner conduit includes a locking collar for fixing the position of the inner conduit relative to the outer tube.

6. The asphalt plant of claim 1, wherein the fuel rod assemblies are disposed in a plurality of rows, each of the rod assemblies being adjustably positioned within the corresponding one of the outer tubes independently of other rod assemblies.

7. In an asphalt plant having a variety of asphalt processing components, a media burner for providing thermal energy to a first selected set of the components and for mitigating fugitive emissions captured from a second selected set of the components, the media burner comprising:

an enclosed combustion chamber defined in part by a top wall, a bottom wall, and an interconnecting sidewall, a portion of the combustion chamber containing a matrix of ceramic members;

an adjustable internal fuel delivery system for delivering fuel to a selected location in the combustion chamber, the fuel delivery system including a fuel manifold and a plurality of fuel rod assemblies having a portion extending into the combustion chamber, each of the fuel rod assemblies including an outer tube having a sidewall with at least one fuel port, the sidewall defining a chamber, each of the fuel rod assemblies further including an inner conduit disposed within the outer tube and being in flow communication with the fuel manifold, the inner conduit including an outlet end having an orifice for delivering fuel to the outer tube chamber, so that the outer tube fuel port delivers fuel from the outer tube chamber to the combustion chamber;

an air inlet plenum for delivering combustion air to the combustion chamber;

a duct system including a first portion being operatively connected to the first component set and being adapted to convey the thermal energy to the first component set, and further including a second portion operatively connecting the air inlet plenum to the second component set and being adapted to capture fugitive emissions from the second component set and to convey the captured emissions to the air inlet plenum for mitigation by the combustion chamber.

8. The media burner of claim 7, wherein the inner conduit includes an inlet end connected to the fuel manifold by a flexible hose.

9. The media burner of claim 7, wherein the inner conduit includes a pair of spaced apart seals sized to be received within the outer tube, the seals cooperating to confine the fuel to a selected portion of the outer tube cavity.

10. The media burner of claim 9, wherein the outer tube includes a plurality of fuel ports spaced along the length of the outer tube and wherein the inner conduit is slidably disposed within the outer tube, thereby permitting the selected portion to be adjusted along the length of the outer tube to deliver the fuel to a selected one of the fuel ports.

11. The media burner of claim 10, wherein the inner conduit includes a locking collar for fixing the position of the inner conduit relative to the outer tube.

12. The media burner of claim 7, wherein the fuel rod assemblies are disposed in a plurality of rows, each of the rod assemblies being adjustably positioned within the corresponding one of the outer tubes independently of other rod assemblies.

13. An asphalt plant, comprising:

a plurality of asphalt processing components, a selected first set of the components producing volatile emissions;

a central media burner operatively connected to a selected second set of components for providing heat energy to the second component set, the media burner having an enclosed combustion chamber defined in part by a top wall, a bottom wall, and an interconnecting sidewall, a portion of the combustion chamber containing a matrix of flame arresting ceramic members;

a fuel delivery system adapted to deliver combustion fuel to the combustion chamber, the fuel delivery system including a fuel manifold and a plurality of fuel rod assemblies having a portion extending into the combustion chamber, each of the fuel rod assemblies including an outer tube having a sidewall defining a chamber, with the outer tube sidewall having at least one fuel port, and an inner conduit disposed within the outer tube and being in flow communication with the fuel manifold, the inner conduit including an outlet end having an orifice for delivering fuel to the outer tube chamber to thereby deliver fuel from the outer tube chamber to the combustion chamber;

a first duct system in flow communication with the first component set and the central media burner, the first duct system including a fan and being adapted to capture a portion of the volatile emissions produced by the first component set and convey the captured emissions into the central media burner for mitigation; and a second duct system in flow communication with the second component set and the central media burner, the second duct system including a fan and being adapted to convey heat energy from the central media burner to the second component set.

14. The asphalt plant of claim 13, wherein the inner conduit includes an inlet end connected to the fuel manifold by a flexible hose.

15. The asphalt plant of claim 13, wherein the inner conduit includes a pair of spaced apart seats sized to be received within the outer tube, the seals cooperating to confine the fuel to a selected portion of the outer tube cavity.

16. The asphalt plant of claim 15, wherein the outer tube includes a plurality of fuel ports spaced along the length of the outer tube and wherein the inner conduit is slidably disposed within the outer tube, thereby permitting the selected port ion to be adjusted along the length of the outer tube to deliver the fuel to a selected one of the fuel ports.

17. The asphalt plant of claim 16, wherein the inner conduit includes a locking collar for fixing the position of the inner conduit relative to the outer tube.

18. The asphalt plant of claim 13, wherein the fuel rod assemblies are disposed in a plurality of rows, each of the rod assemblies being adjustably positioned within the corresponding one of the outer tubes independently of other rod assemblies.

* * * * *